US007544122B2

(12) United States Patent
Ohwada et al.

(10) Patent No.: US 7,544,122 B2
(45) Date of Patent: Jun. 9, 2009

(54) AIR SHUTTER AND INSTALLATION METHOD THEREOF

(75) Inventors: Sachio Ohwada, Koto-ku (JP); Kouichi Tsubata, Koto-ku (JP); Seiichi Sakuma, Koto-ku (JP); Shinjirou Akaboshi, Koto-ku (JP); Akira Yasutome, Koto-ku (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 331 days.

(21) Appl. No.: 11/397,881

(22) Filed: Apr. 5, 2006

(65) Prior Publication Data

US 2006/0199500 A1 Sep. 7, 2006

Related U.S. Application Data

(62) Division of application No. 10/733,756, filed on Dec. 12, 2003, now Pat. No. 7,037,189.

(30) Foreign Application Priority Data

May 27, 2003 (JP) ..... 2003-149544

(51) Int. Cl.
*F24F 9/00* (2006.01)

(52) U.S. Cl. ..... 454/191; 454/190; 454/192; 454/188

(58) Field of Classification Search ..... 454/191, 454/188, 190, 192
See application file for complete search history.

(56) References Cited

U.S. PATENT DOCUMENTS

| | | | |
|---|---|---|---|
| 3,190,207 | A | 6/1965 | Weisz |
| 3,282,193 | A | 11/1966 | Jennings |
| 3,817,160 | A | 6/1974 | Searcy et al. |
| 6,106,387 | A | 8/2000 | Smith |

FOREIGN PATENT DOCUMENTS

| | | |
|---|---|---|
| JP | 37-12183 | 8/1937 |
| JP | 51-118149 | 10/1976 |
| JP | 05-073436 U | 10/1993 |
| JP | 2000-88312 | 3/2000 |
| SU | 1399606 | 5/1988 |

*Primary Examiner*—Steve McAllister
*Assistant Examiner*—Helena Kosanovic
(74) *Attorney, Agent, or Firm*—Crowell & Moring LLP

(57) ABSTRACT

An air shutter of low cost, high efficiency, and easy maintainability is provided, which can interrupt efficiently the flowage of air across a doorway when the door is open based on the consideration of the experimental data of the flowage of air across the opening area of the doorway of a cold storage. The air shutter comprises a gatepost 12 and a gatepost 13 installed at both sides of the opening area of a doorway. The gatepost 12 is provided with a lower slit nozzle 12*a*, a suction opening 12*b*, and lower fans 12*c* and a suction duct 12*d* inside thereof, on the other hand, the gatepost 13 provided with an upper slit nozzle 13*a*, a suction opening 13*b*, and lower fans 13*c* and a suction duct 13*d* inside thereof.

2 Claims, 11 Drawing Sheets

AIR SHUTTER AND INSTALLATION METHOD THEREOF

CROSS REFERENCE TO RELATED APPLICATIONS

The present application is a division of application Ser. No. 10/733,756, filed Dec. 12, 2003, which claims benefit to Japanese priority application no. 2003-149544, filed May 27, 2003, whose disclosure is hereby incorporated by reference in its entirety into the present application.

BACKGROUND OF THE INVENTION

1. Field of the invention

The present invention relates to an air shutter to be installed at the entrance where temperature difference exists between inside and outside thereof for preventing air flow through the entrance, that is, the intrusion of outside air and extrusion of inside cold air.

2. Description of the Related Art

An air curtain producing apparatus for preventing the intrusion of outside air through the doorway of the thermal insulation door used in a building is disclosed in Japanese Patent No. 37-12183.

Said invention proposes an air curtain producing apparatus composed such that air is spouted out from both sides of the doorway in a direction horizontal or slanted downward to form two air streams flowing in the direction opposite to each other, each air stream being located parallel to each other in the direction perpendicular to the entrance plane, a whirl stream being generated between said two air streams.

However, with said apparatus, a problem is involved that the amount of air to form the air streams is larger compared with an air curtain producing apparatus in which an air curtain is formed with the air spouted out from one side of the doorway.

Among proposals disclosed afterward, there is a proposal disclosed in Japanese Patent Laid-Open publication No. 51-118149. The proposed air curtain producing apparatus is composed such that, as seen in FIG. 9, the circulation air transferred through a fan 110 provided in the top part of a portal-shaped duct 106 of for forming an air curtain is changed in its flow direction by 180 degrees in the vertical part of the duct by guides 108, so the air is spouted out in the direction slanting downward particularly in the region near the top of the portal-shaped duct where the velocity of the spouting air is large. Therefore, there is a problem that air curtain is difficult to be formed in the upper region of the entrance and the effect of preventing the intrusion of outside warm air in the upper region of the entrance is weak.

Further, with the apparatus according to the proposal, since the recirculation fan 110 is located in the upper part of the portal-shaped duct 106, the maintenance of the thermal insulating door not shown in the drawing is difficult.

Another example of air curtain producing apparatus proposed in the past is shown in FIG. 10A and FIG. 10B showing a section taken along lines □-□ in FIG. 10A. According to the proposal, a portal-shaped duct 53, in which an air recirculation passage 55 is formed and an air recirculation fan 54 is located in the passage, is provided outside thermal insulation doors 57, 57. The doors can be slid to be opened or closed while contacting a seal member of rubber or vinyl provided between the rear faces of the doors and the outer face 51 of the wall 50 of a building. An air curtain 56 is formed between the opposing vertical side faces 53*a*, 53*a* of the duct 53 by spouting out air from a slit provided in the face 53*a* of the left side vertical duct part of the duct 53 and sucking the air from a slit provided in the face 53 of the right side of the vertical duct part of the duct 53 to prevent the intrusion of outside air into the building.

Each of clearances 53*b*, 53*b* between the rear side face of each of the vertical duct parts of the duct 53 and each of said thermal insulation doors is sealed by means of a seal member of rubber or vinyl.

With the apparatus described above, when the thermal insulation doors 57, 57 are slid toward left and right to open the entrance as shown in FIG. 10B, even if the air curtain 56 is formed in front of the space 65*a* surrounded by a broken line formed between said doors when they are opened, the intrusion of outside air through the clearance formed above the top of the space 65*a* can not be prevented. Therefore, sufficient effect of interception of outside air cannot be achieved.

Still another proposal is disclosed in Japanese Patent Laid-Open publication No. 5-73436. According to the proposal, as shown IN FIG. 11A and FIG. 11B showing a section taken along lines VII-VII in FIG. 11A, thermal insulating doors 60, 61 are provided for slide outside the wall 50 of a building, the doors being packed with insulation material 52, a seal member 51 being provided around the opening of the wall 50. Sirocco fans 60*a* and 60*b* are provided to the left and right end of the thermal insulating doors 60*a* and 60*b* respectively. Outside air sucked by the fan 61*a* passes through the air passage formed outside the right door 61 is sprouted out therefrom toward the air passage formed outside the left door 60 and sucked thereinto by the fan 60*a* in order to form an air curtain 62 in front of the space 65*b* between both the doorway side ends of the opened doors 60, 61. The air is exhausted from the fan 60*a* toward outside.

With the proposal, although an air curtain 62 is produced in front of the space 65*b* to intersect air flow between the outside and inside of the building, there remains a problem that the intrusion of outside air from the clearance above the top of the space 65*b* cannot be prevented.

Further, with the proposal, the temperature of the interception air stream is considerably higher compared with that of the inside cold air because the air stream consists of the outside air sucked from the right side of the thermal insulation door 61, and white smoke tends to be generated due to the condensation of the moisture in the air stream as a result of the contact or mixing of the air stream with the inside cold air. The white smoke induces poor visibility from outside. There occurs also a problem that ice is formed on the floor and on the doorway-side end faces of the door 60 and 61 where the inside cold air mixes with the air stream which consists of only outside air of higher temperature.

As has been mentioned above, with lateral flow type air curtain producing apparatuses of prior art, there is a problem that outside air intrudes from the clearance formed above the top of the opened space of doorway when doors are opened.

In FIG. 10C is shown in a sectional view a down-flow type air curtain producing apparatus which has been used widely hitherto.

As can be seen in the drawing, a down-flow type air curtain producing apparatus 63 is of a simple construction, which is provided above the outer wall 50 of a building and produces interception air stream 63*a* flowing downward over the top of the door 64, has been widely used because of its simplicity. However, the interception effect is decreased near the floor where the velocity of the air stream is lowest, and white smoke is generated due to the condensation of the moisture in the air stream as a result of mixing of it with the cold air leaking out from inside, inducing poor visibility from outside and also ice is formed on the floor.

With the down-flow type air curtain, as the flow angle of air is constant, stable curtain effect is difficult to be obtained, and when the difference in air temperature between the inside and outside of the building, the effect of interception near the bottom part of the air curtain decreases. Particularly in the bottom region of the air curtain where the air velocity is small, the air curtain tends to be broken.

As the down-flow type air curtain involves problems as mentioned above, it is difficult to sufficiently prevent the cold air from leaking out from inside.

To solve the problems mentioned above, the inventers of the present application proposed in Japanese Patent Laid-Open Publication No. 2000-249382 an air curtain producing apparatus, with which the problem of the decrease of interception effect near the end of the down-flowing air stream as is observed in the down-flow type air curtain of prior art and the problem of the condensation due to the leakage of cold air observed in the lateral flow-type air curtain are solved, and an air curtain with high efficiency in interception and without the occurrence of condensation of moisture can be produced.

According to the proposal, as shown FIG. 12, the apparatus is composed as follows:

(a) Each of the thermal insulation door leaf 71 and 72 of a double-leaf door is provided in the doorway side thereof an air spouting opening 76 and 73, an air sucking opening 74 and 77, and an air circulation fan 83 and 84 respectively in order to produce a circulating interception air stream comprising a lower side interception air stream 78*a* and an upper side interception air stream 78*b* is formed.

(b) That is, a cold air interception air stream 78*a* is formed in the lower region of the doorway to prevent the cold air in the inside from leaking out, a hot air interception air stream 78*b* is formed in the upper region of the doorway to prevent the hot air (outside air) from intruding into the inside, and the air of said interception air streams circulates from the one to the other stream.

(c) Further, a down-flow air stream 79 is formed using a part of the circulating air flowing in the upper part of the doorway.

(d) The air spouting out angle of the lower interception air stream, i.e. the cold air interception air stream 78*a* is inclined toward inside and the angle of inclination is variable depending on conditions in order to achieve higher interception efficiency.

As described above, according to the proposal, a down-flow air stream 79 and a lateral-flow hot air interception air stream 78*b* are formed in order to prevent outside air from intruding inside, and a lateral-flow cold air interception air stream 78*a* is formed in order to prevent the cold air in the inside 80 from flowing out to the outside, the air of the down-flow air stream and the hot air interception air stream 78*b* being introduced to the fan 83 to form the cold air interception air stream 78*a*.

According to the proposal, although it is possible to prevent the occurrence of white smoke due to the condensation of the moisture in outside hot air as occurred with apparatuses of prior art by forming the circulating interception air stream comprising the hot air interception air stream and cold air interception air stream, the problem concerning efficient interception between inside and outside was not solved enough.

SUMMARY OF THE INVENTION

The object of the present invention is to provide an air shutter of low cost, high efficiency, and easy maintainability, which can efficiently interrupt the flow of air particularly across the opening area of a doorway based on experimental data of the flowage of air across the opening area of the doorway of a cold storage.

The first invention of the air shutter according to the present invention proposes an air shutter to be installed in front of a doorway where temperature difference exists between the inside and outside thereof in order to interrupt the flowage of air through the doorway, characterized in that the upper zone and lower zone of the opening area of the doorway are respectively defined as a hot air interception zone and cold air interception zone, between them existing a windless boundary, a hot air interception air stream is formed over said hot air interception zone and a cold air interception air stream is formed over said cold air interception zone, and both the air streams are formed by the circulation air circulating from one to the other interception air stream.

The first invention cited above is the basic construction of the air shutter of the present invention, with which outside air (hot air) is prevented from intruding across the opening area and the cold air is prevented from flowing out to the outside of the opening area.

In FIG. 4A and FIG. 4B is shown the result of air flow across the opening area as explained later in detail. As can be seen in the drawing, the velocity of the air flowing out across the opening area is at maximum near the floor, it decreases with the increase of height from the floor, at the point of 0.8H it becomes zero (H is the height of the opening area), and in the zone upward it increases inversely, that is, outside air (hot air) intrudes into the inside across the opening area. Most of the opening area is a cold air extruding zone, upper small part is a hot air intruding zone, and between them is a windless boundary.

In the present invention, taking the experimental result into consideration, the upper part is defined as a hot air interception zone and the lower part is defined as a cold air interception zone, a faster interception air stream is formed in the hot air interception zone by allowing air to spout out from a nozzle of smaller opening area and a slower interception air stream is formed in the cold air interception zone by allowing air to spout out from a nozzle of larger opening area.

The air of the streams is allowed to circulate. The circulation air decreases in temperature than that of outside air by the contact and mixing with the cold air inside the opening area, and the temperature difference between the interception air stream and outside air decreases. As a result, the generation of white smoke due to the condensation of the moisture in outside air is prevented. That is, during the initial phases of formation of interception air streams, most of the air of the air streams consists of the air of which the temperature is near that of outside air (hot air), and the condensed moisture in the hot air is heated to be released from the condensation in the process of circulation and on the other hand the interception air stream decreases in temperature.

It is preferable that said air shutter comprises a pair of gateposts of which each gatepost is provided at each side of the doorway, said cold air interception air stream is formed by the air spouted out from a cold air interception air stream generating part which comprises a nozzle and a fan or fans and provided in the lower part of one of said gateposts, said hot air interception air stream is formed by the air spouted out from a hot air interception air stream generating part which comprises a nozzle and a fan or fans and provided in the upper part of the other of said gateposts, and the opening area of the nozzle for forming the cold air interception air stream is larger than that of the nozzle for forming the hot air interception air stream.

As the cold air interception air stream generating part provided with a nozzle and a fan or fans is provided integrally in one of the gate post and the hot air interception air stream generating part provided with a nozzle and a fan or fans is provided integrally in the other of the gatepost, it is not necessary to provide a fan or fans for the circulation of the circulation air outside the gateposts, and the air shutter of simple construction, low cost, and easy maintainability, can be provided.

It is preferable in the air shutter in the first invention that said hot air intersection air stream is formed such that it covers the opening area of the door way over the region of height of 0.1H~0.4H (H is the height of the opening area of the doorway) from the top of the area and said cold air intersection air stream is formed such that it covers the opening area of the door way over the region of height of 0.5H~0.9H from the floor.

This was determined in consideration of the experimental data shown in FIG. 4A and FIG. 4B.

FIG. 4A is an illustration showing the velocity of air passing through the doorway, velocity distribution along the vertical center line being shown, and FIG. 4B is an illustration showing the velocity distribution with velocity vectors.

As mentioned before, the velocity of the air flowing out across the opening area is at maximum near the floor, it decreases with the increase of height from the floor, at the point of 0.8H it becomes zero (H is the height of the opening area), and in the zone upward it increases inversely, that is, outside air (hot air) intrudes into the inside across the opening area. This area is limited to upper small part of the opening area.

Therefore, it was decided to define the hot air interception zone in the range of height of 0.1~0.4H from the top of the opening area and the cold interception zone in the range of height of 0.5~0.9H from the floor, the border zone between the hot air interception zone and the cold interception zone being the windless boundary.

It is preferable in the air shutter of the first invention that the air to form said hot air interception air stream is spouted out slanting inwardly by an angle of 0~20° and the air to form said cold air interception air stream is spouted out slanting outwardly by an angle of 0~20°.

It is suitable in the air shutter of the first invention that said cold air interception air stream generating part and hot air interception air stream generating part are provided in thermal insulation doors for opening or closing the doorway.

It is preferable in the air shutter of the first invention that said gateposts is of a portal-shaped construction provided with an upper crossbeam connecting both gateposts. By this construction, the occurrence of the formation of a clearance above the top of the opened space of the doorway when doors are opened is evaded. Accordingly, the intrusion of outside air over the top of the hot air interception zone can be prevented.

It is preferable in the air shutter of the first invention that a short curtain member is provided in the hot air interception zone in the upper part of the opening area of the door way to interrupt heat flow between the inside and outside of the opening area.

With this construction, the effect of interruption of heat flow in the upper part of the opening area can be enhanced by the short curtain member in addition to that the difference in temperature between the interception air streams and the cold air inside the storage is decreased by the circulation of the air of the interception air streams.

Since the short curtain is provided only in the hot air interception zone in the upper part of the opening area and it does not shield the middle and lower part of the opening area, the short curtain does not obstruct viewing the inside of the cold storage and at the same time does not interfere with the advancing of a service vehicle such as a forklift truck in and out of the cold storage.

The second invention of the air shutter according to the present invention proposes an air shutter to be installed in front of a doorway, where temperature difference exists between the inside and outside thereof and a door of vertically sliding type is provided, for interrupting the flowage of air through the doorway characterized in that a portal-shaped construction which is composed of a pair of gateposts and an upper crossbeam connecting both gateposts; the upper zone and lower zone of the opening area of the doorway are respectively defined as a hot air interception zone and a cold air interception zone, between them existing a windless boundary; said hot air interception air stream is formed such that it covers the opening area of the door way over the region of height of 0.1H~0.4H (H is the height of the opening area of the doorway) from the top of the area and said cold air intersection air stream is formed such that it covers the opening area of the door way over the region of height of 0.5H~0.9H from the floor, said cold air interception air stream being formed by the air spouted out from a nozzle provided in the lower part of one of said gateposts, said hot air interception air stream being formed by the air spouted out from a nozzle provided in the upper part of the other of said gateposts, the opening area of the nozzle for forming the cold air interception air stream being larger than that of the nozzle for forming the hot air interception air stream; and the air to form said hot air interception air stream is spouted out slanting inwardly by an angle of 0~20° and the air to form said cold air interception air stream is spouted out slanting outwardly by an angle of 0~20°.

The air shutter of said second invention relates to an air shutter installed in front of the doorway of a vertically sliding door to intercept the air flow across the doorway, there being a temperature difference between the outside and inside of the doorway. A portal-shaped construction composed of a left and right gatepost and an upper crossbeam connecting both gateposts is provided adjacent to said vertically sliding door, the hot air interception air stream generating part and cold air interception air stream generating part of the first invention are provided in each of said gatepost respectively, and a circulating interception air stream comprising a hot air interception air stream and a cold air interception air stream is formed.

The coverage zone of each of the hot air interception air stream and cold air interception air stream and the angle of air spouting-out direction are the same with the case of said first invention.

The third invention of the air shutter according to the present invention proposes an air shutter to be installed in front of a doorway, where temperature difference exists between the inside and outside thereof, to interrupt the flowage of air through the doorway, characterized in that a pair of gateposts is installed of which each gatepost is provided at each side of the doorway to oppose to each other, a duct for air passage being formed in each gatepost, each gatepost being provided with air spouting out openings and air sucking openings along the direction of height such that each of the air spouting out openings of one side gatepost faces, or is opposite to, each of the air sucking openings of the other side gatepost respectively, a plurality of fans being provided behind each of said air spouting out openings; one of the gatepost is provided with the air spouting openings and fans located in the upper part and in the lower part thereof; the other of the gatepost is provided with the air spouting openings and fans located in the middle part in the direction of height thereof; and air is spouted out from the air spouting openings toward the corresponding opposite air sucking openings.

According to the invention, the air spouting openings and fans of the gatepost at one side are located in the upper and lower part of said gatepost and air is spouted out from the air spouting out openings toward the air sucking openings provided in the gatepost at the other side, and the air spouting openings and fans of the gatepost of the other side are located in the middle in the height direction of said gatepost and air is spouted out from the air spouting out openings toward the air sucking openings provided in the gatepost at said one side, so that by dividing a plurality of fans provided in the pair of gateposts into at least three groups having three suction passages, i.e. a fan group located in the upper part and a fan group located in the lower part respectively of the gatepost of one side and a fan group located in the middle part of the gatepost of the other side, the length of the suction passages of the fans can be reduced resulting in smooth flow passage eliminating the interference of suction flow between the fans.

By this configuration, the suction resistance of each of the fans is reduced, the increase of negative suction pressure due to small width of suction passages is suppressed, and as a result the reduction in the velocity, that is, in the flow rate of the circulation air, which will be accompanied by the increase of negative suction pressure, can be prevented.

Further, in the invention, it is preferable that the fans located in the middle part are divided into two groups, and each group of fans sucks air through each suction passage divided into two by a partition member for dividing the duct inside the other side gatepost.

With this construction, the fans located in the middle part can be divided into two groups of fans having two passages, as a result all of the fans can be divided into four groups having four suction passages, and the effect of suppressing the increase in negative suction pressure can be further enhanced.

Further, the fourth invention of the air shutter is a method of installing the air shutter characterized in that seal elements for air sealing are provided between the doors to open and close the doorway and the gateposts of the first~third inventions.

By the invention, the air sealing between the gateposts and the doors can be positively achieved by simply providing the seal elements on the gateposts such that the doors slide keeping contact with the seal elements.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
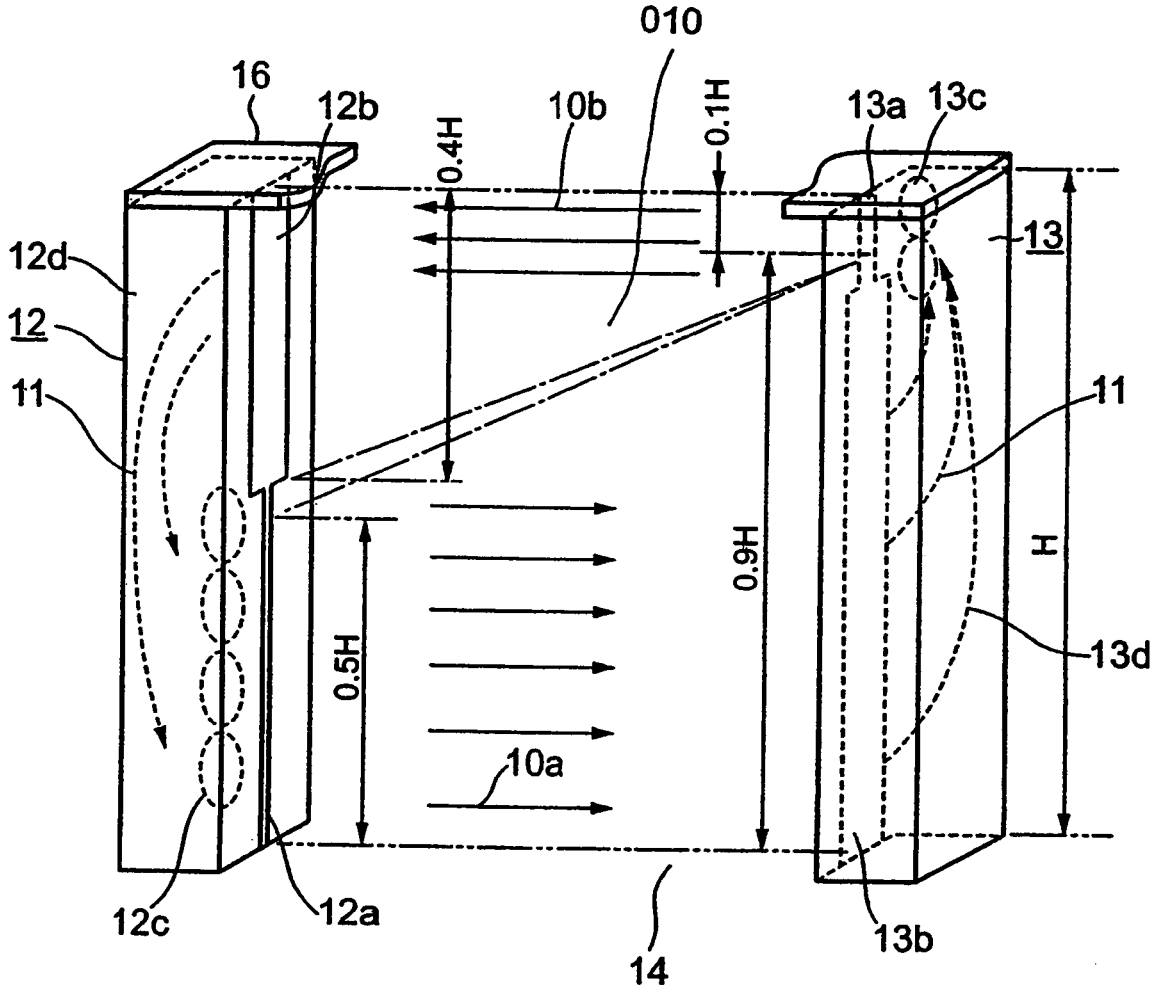
FIG. 1 is a perspective view schematically showing the configuration of the air shutter according to the first embodiment of the present invention.
Figure 2A:
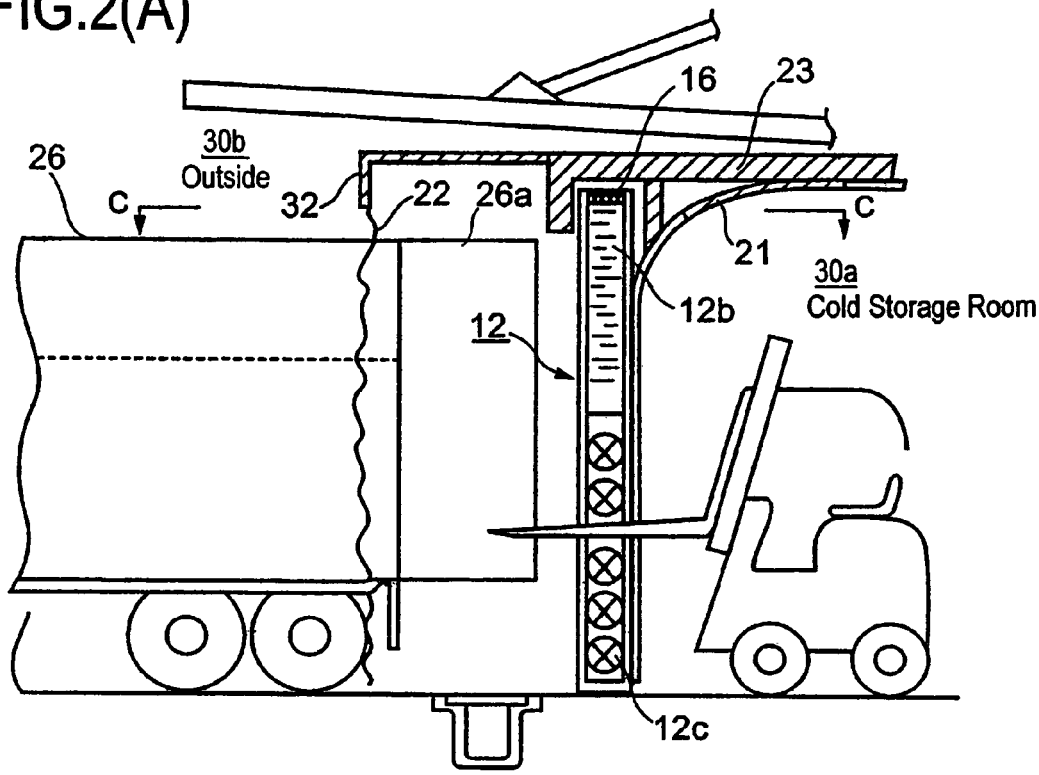
FIG. 2A is a longitudinal sectional view of the installed state of the air shutter according to the second embodiment of the present invention showing when goods are carried into or out of the storage from or to a truck in the case the door of the storage room is of an overhang door (vertically sliding door)
Figure 2B:
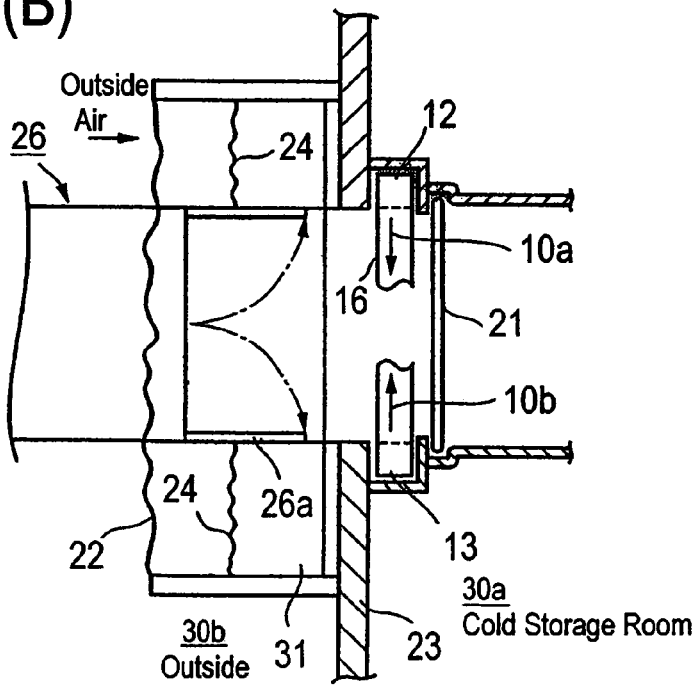
FIG. 2B is a section along lines C-C in FIG. 2A.
Figure 3:
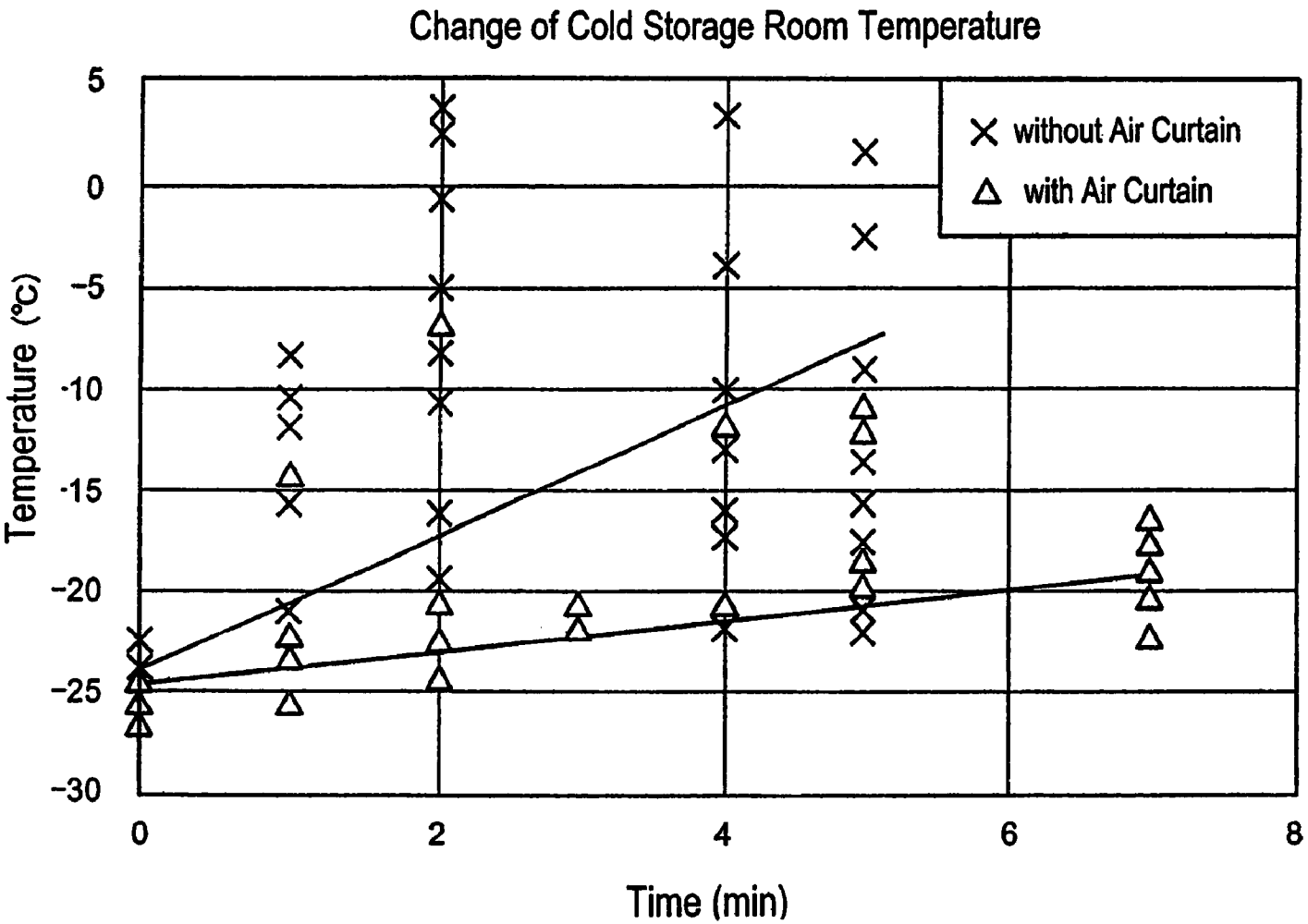
FIG. 3 is a graph showing the change of temperature in storage with time when the air curtain is formed and not formed.
Figure 4A:
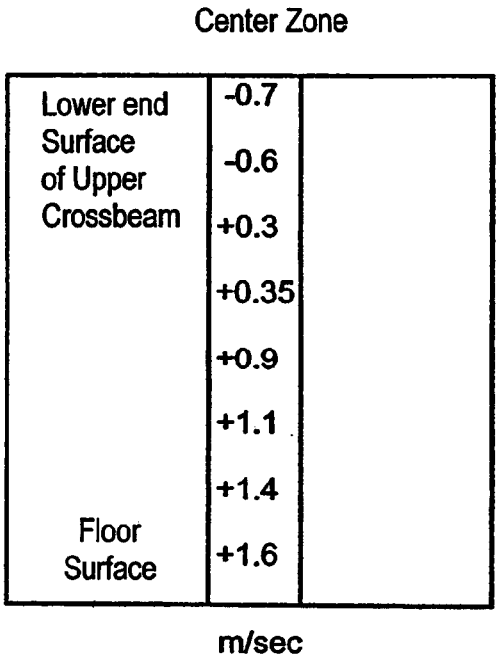
FIG. 4A is an illustration showing the air velocity distribution along the vertical center line passing through the doorway.
Figure 4B:
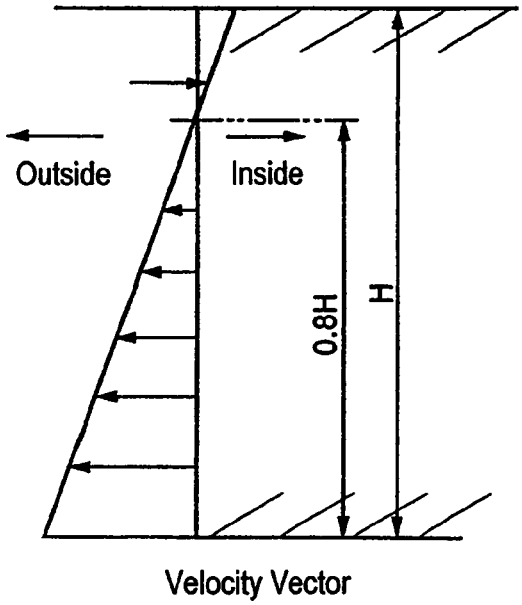
FIG. 4B is an illustration showing the velocity distribution with velocity vectors.
Figure 5A:
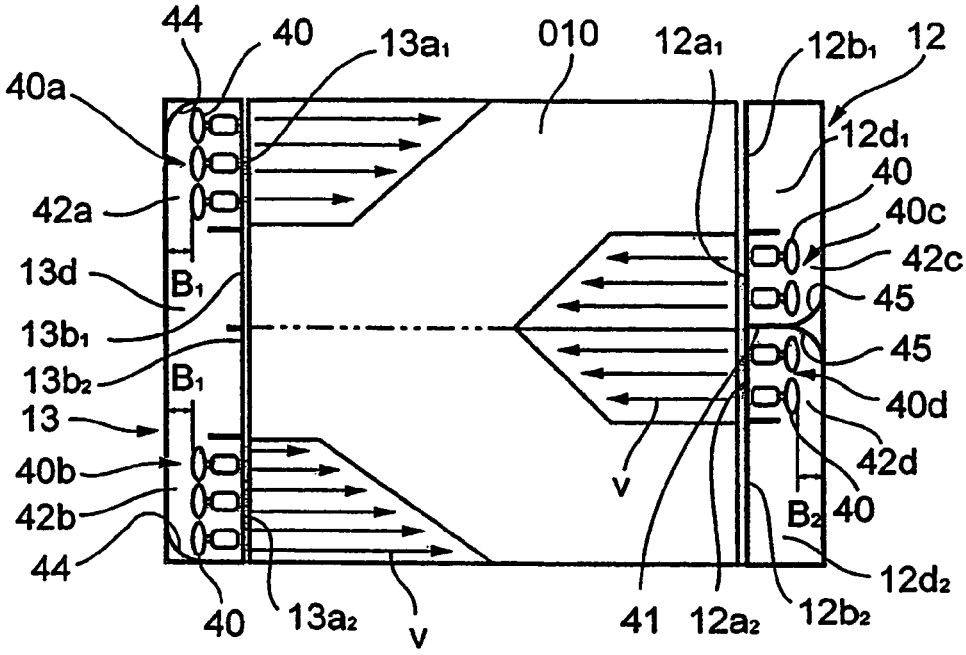
FIG. 5A is a front view of the third embodiment of the air shutter according to the present invention schematically showing fan arrangement.
Figure 6:
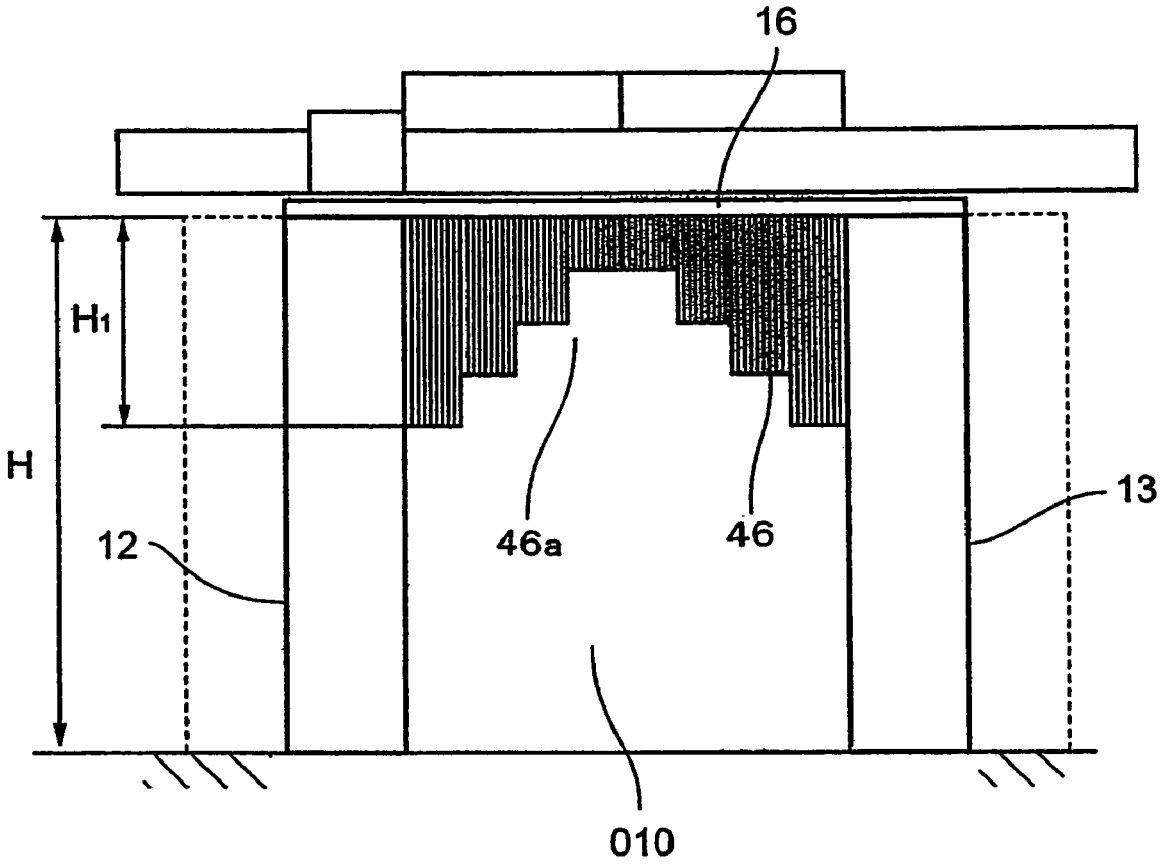
FIG. 6 is a front view of the air shutter of the fourth embodiment according to the present invention showing the arrangement of short curtains.
Figure 7:
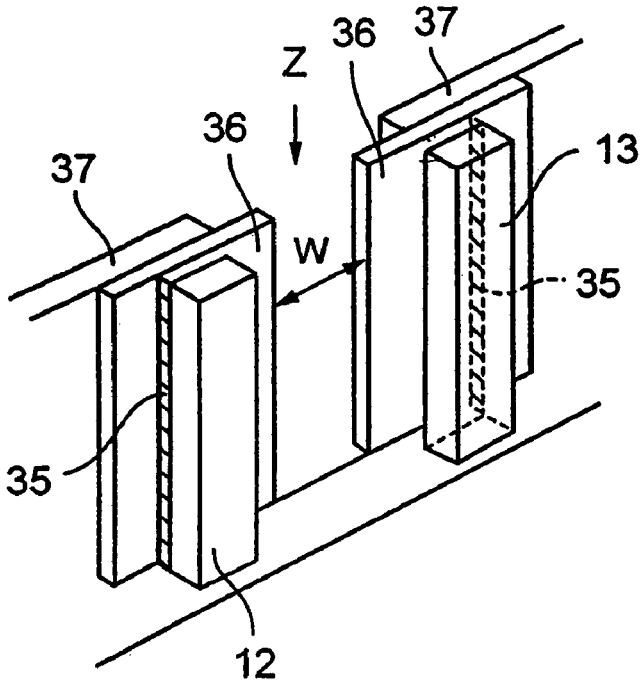
FIG. 7 is a perspective view of the air shutter of the fifth embodiment according to the present invention showing the seal member attached to seal the clearance between the double-leaf door and the air shutter.
Figure 8:
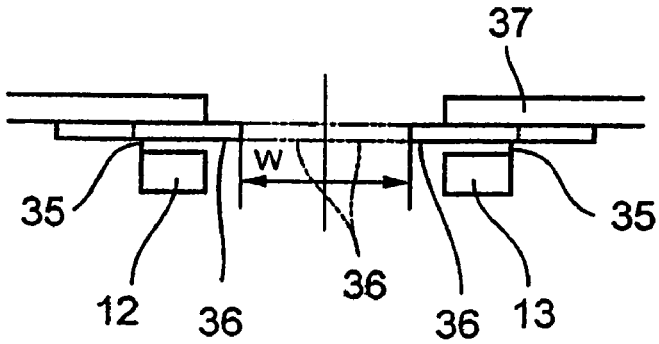
FIG. 8 is a view in the direction of arrow Z in FIG. 7.
Figure 9:
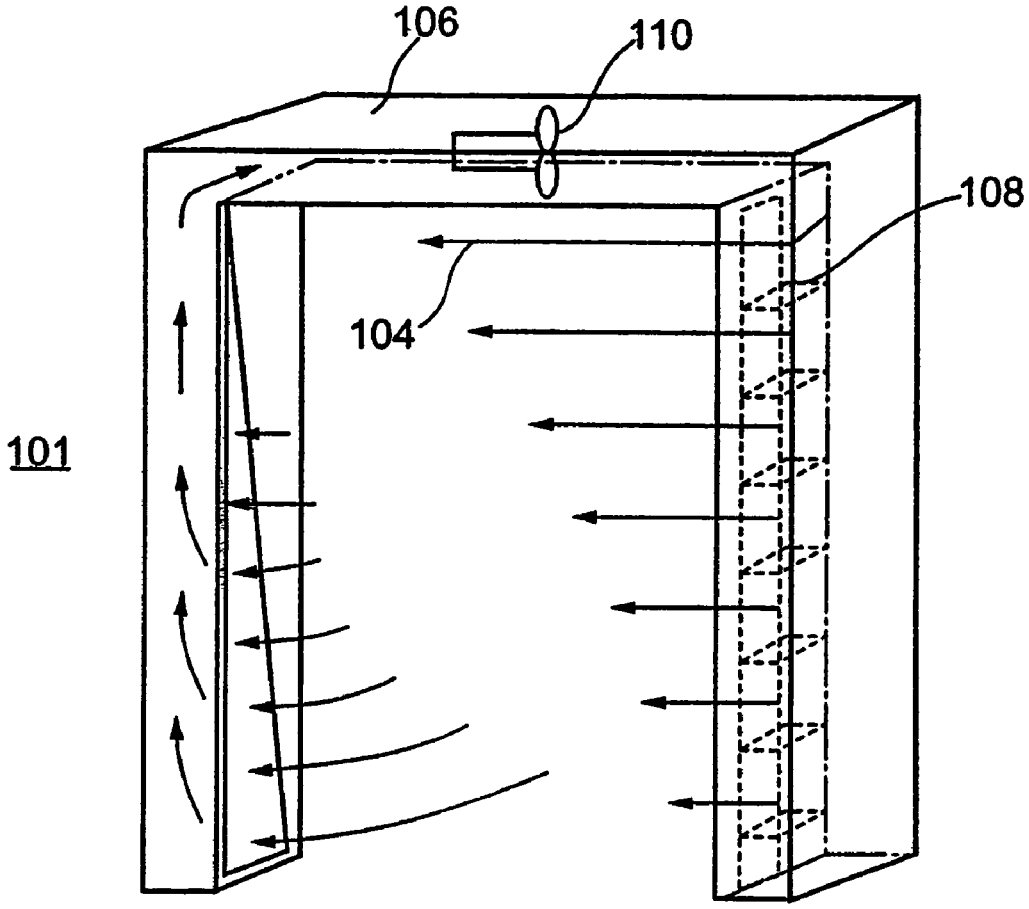
FIG.9 Prior Art
FIG. 9 is a perspective view showing schematically the configuration of an example of portal-shaped air curtain producing apparatus of prior art.
Figure 10A:
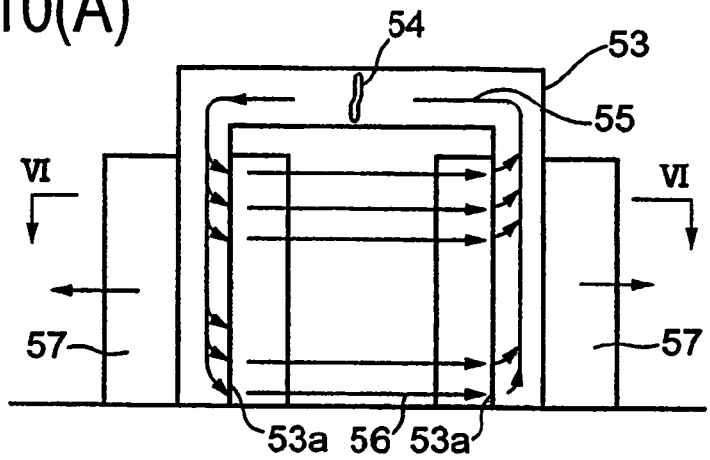
Prior Art FIG.10(A)
FIG. 10A is a front view showing schematically the configuration of another example of air curtain producing apparatus of prior art.
Figure 10B:
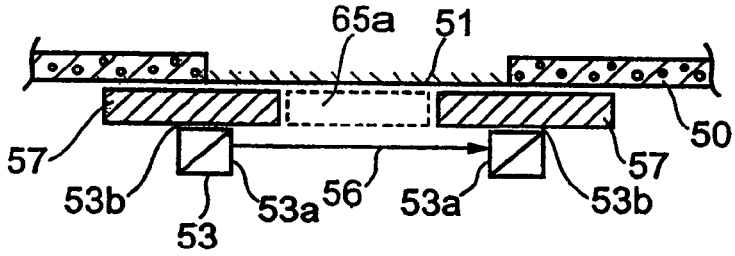
FIG. 10B is a section taken along lines VI-VI in FIG. 10A.
Figure 10C:
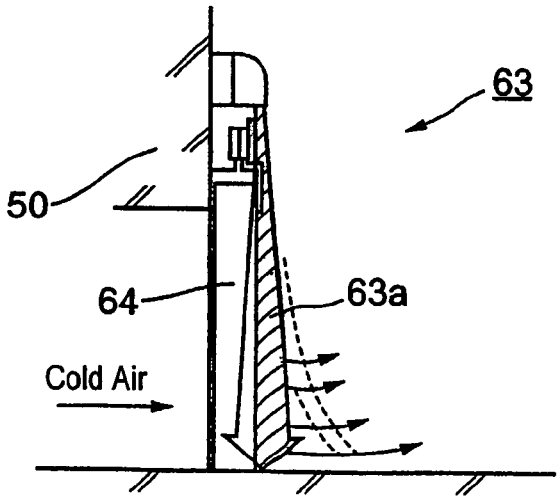
FIG. 10C is a side view of an example of down-flow type air curtain producing apparatus of prior art.
Figure 11A:
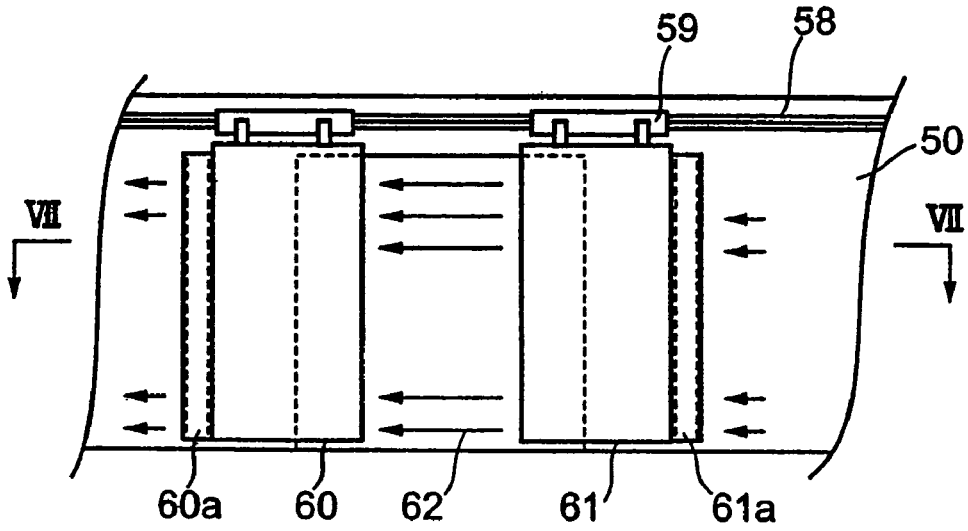
Prior Art FIG.11(A)
FIG. 11A is a front view schematically showing the configuration of another example of air curtain producing apparatus of prior art.
Figure 11B:
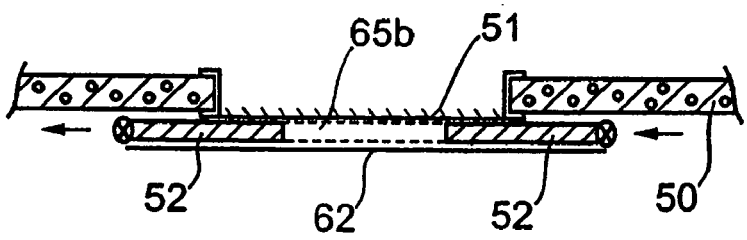
FIG. 11B is a section taken along lines VII-VII in FIG. 11A.
Figure 12:
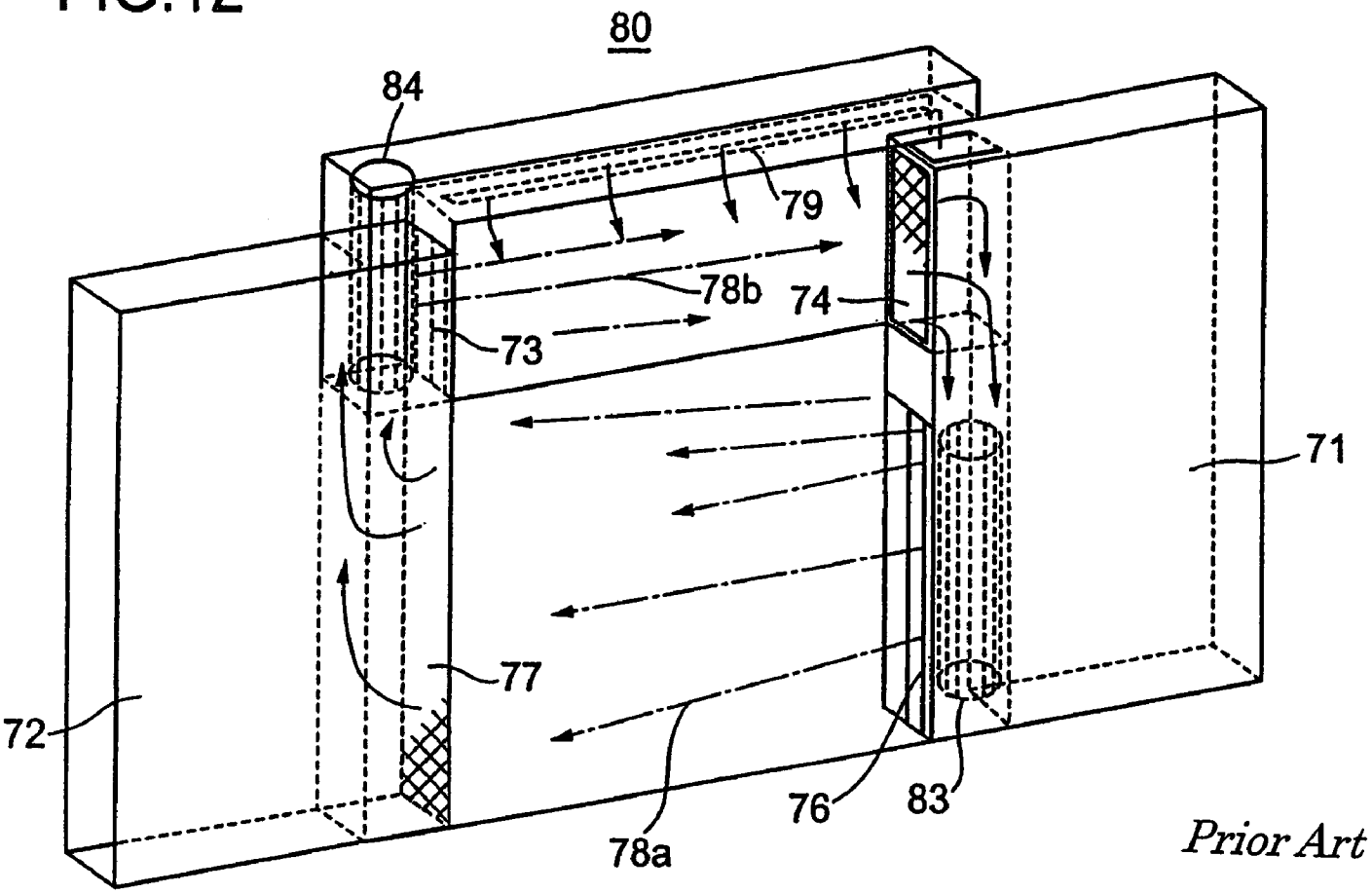
FIG.12 Prior Art
FIG. 12 is a perspective view showing schematically the configuration of anther example of air curtain producing apparatus of prior art with which a horizontally flowing hot air interception air stream, horizontally flowing cold air interception air stream, and a vertically flowing hot air interception air stream are formed.

FIG. 1 is a perspective view schematically showing the configuration of the air shutter according to the first embodiment of the present invention. FIG. 2A is a longitudinal sectional view of the installed state of the air shutter according to the second embodiment of the present invention showing when goods are carried into or out of the storage from or to a truck in the case the door of the storage room is of an overhang door (vertically sliding door), and FIG. 2B is a section along lines C-C in FIG. 2A. FIG. 3 is a graph showing the change of temperature in storage with time when the air curtain is formed and not formed. FIG. 4A is an illustration showing the air velocity distribution along the vertical center line passing through the doorway, and FIG. 4B is an illustration showing the velocity distribution with velocity vectors. FIG. 5A is a front view of the third embodiment of the air shutter according to the present invention schematically showing fan arrangement, and FIG. 4B is a front view of an example for comparison showing fan arrangement. FIG. 6 is a front view of the air shutter of the fourth embodiment according to the present invention showing the arrangement of short curtains. FIG. 7 is a perspective view of the air shutter of the fifth embodiment according to the present invention showing the seal member attached to seal the clearance between the double-leaf door and the air shutter, and FIG. 8 is a view in the direction of arrow Z in FIG. 7.

Referring to FIG. 1, the first embodiment of the air shutter according to the present invention is composed of a portal-shaped construction comprising a gatepost 12 for producing a cold air interception air stream, a gatepost 13 for producing a hot air interception air stream, and an upper crossbeam 16 connecting both the gateposts, the portal-shaped construction being installed in front of the doorway of a cold storage. A lower slit nozzle 12*a* is provided in the lower part of the doorway side face of said gatepost 12, the lower end of the lower slit nozzle 12*a* reaches the floor 14. Above the lower slit nozzle 12*a* is provided a suction opening 12*b* extending upward until it reaches the upper crossbeam 16. Inside the gatepost 12 are provided lower side fans 12*c* and a suction duct 12*d* which guides the circulation air 11 sucked from the suction opening 12*b* to the suction side of said lower side fans 12*c*.

On the other hand, an upper slit nozzle 13*a* is provided in the upper part of the doorway side face of said gatepost 13, the upper end of the slit nozzle 13*a* reaches the upper crossbeam 16. Below the upper slit nozzle 13*a* is provided a suction opening 13*b* extending downward until it reaches the floor 14. Inside the gatepost 13 are provided upper side fans 13*c* and a suction duct 13*d* which guides the circulation air 11 sucked from the suction opening 13*b* to the suction side of said upper side fans 13*c*.

The upper crossbeam 16 connecting the gatepost 12 and 13 define the upper end of the opening area 010 of the portal-shaped construction, so the air shutter of portal-shaped construction can be installed in front of the doorway so that there does not remain a clearance above the laterally flowing hot air interception air streams and intrusion of outside air is perfectly prevented.

The height of the lower slit nozzle 12*a* from the floor is about 0.5H (H is the height of the opening area 010), and the air spouted out from the lower slit nozzle 12*a* forms a cold air interception air stream 10*a*. The vertical length of the upper slit nozzle 13*a* is about 0.1H from the upper crossbeam, and the air spouted out from the upper slit nozzle 13*a* forms a hot air interception air stream 10*b*.

The opening area of the lower slit nozzle 12*a* is larger than that of the upper slit nozzle 13*a*, so the velocity of the cold air interception air stream 10*a* is smaller than that of the hot air interception air stream 10*b*. The suction opening 13*b* provided in the gatepost 13 extends from the floor 14 to the height of about 0.9H, so the slower air stream 10*a* spouted out from the lower slit nozzle 12*a* of the gatepost 12 is expanded to the height of about 0.9H from the floor 14 when it reaches the suction opening 13*b* of the gatepost 13, thereby the air stream is sucked. The faster air stream 10*b* spouted out from the upper slit nozzle 13*a* is expanded to the vertical length of about 0.4H from the upper crossbeam 16 when it reaches the suction opening 12*b* of the gatepost 12, thereby the air stream is sucked.

With the configuration described above, the faster air stream spouted out from the upper slit nozzle 13*a* forms the hot air interception air stream 10*b* in the hot air interception zone.

Said faster air stream 10*b* is sucked from the suction opening 12*b* of the gatepost 12, passes through the suction duct 12*d*, and spouted out from the lower slit nozzle 12*a* by means of the lower fans 12*c* to form the cold air interception air stream 10*a* of slower speed in the cold air interception zone.

Said slower air stream is sucked from the suction opening 13*b* of the gatepost 13, passes through the suction duct 13*d* and again spouted out from the upper slit nozzle 13*a* by means of the upper fans 13*c*.

Thus, a circulation air stream path is formed.

Referring to FIG. 2A and FIG. 2B, the cold storage room 30*a* is partitioned by an overhang door 21 (vertically sliding door) from the room 31 for disposal of goods located in the outside 30*b*. The portal-shaped construction composing the air shutter of the present invention comprising a gatepost 12 for producing a cold air interception air stream, a gatepost 13 for producing a hot air interception air stream, and an upper crossbeam 16, is installed in front of the doorway of the overhang door 21.

The drawing shows the state that a truck 26 is advanced into the disposal room 31 provided with a pent roof 32, a curtain 22, and a shelter 24; a double-leaf hinged door 26*a* of the truck 26 is opened; and the overhang door 21 is slid upward to open the doorway between the cold storage room 30*a* and disposal room 31 located outside the storage room 30*a*.

The overhang door 21 is opened after the truck is advanced into the disposal room, and the air shutter is operated and the cold air interception air stream 10*a* and hot air interception air stream 10*b* are formed.

In this case, the gatepost 12, gatepost 13, and upper crossbeam 16 are surrounded with a panel 23 as shown in the drawing so that the periphery of the portal-shaped construction is hermetically sealed against the storage room 30*a*.

With the air shutter of the present invention, it is enough that the portal-shaped construction is installed in front of the doorway of the cold storage room with the periphery thereof sealed hermetically against the storage room, so that the shutter can be applied to cases of any kind of type of door, and an air shutter of low cost and enhanced maintainability can be provided.

FIG. 3 is a graph showing the change of cold storage room temperature vs. time lapse when the air shutter of FIG. 1 was provided and air curtain was formed, and when air curtain is not formed. As can be recognized from the graph, the change of room temperature of −24° C. after 4 minutes was as follows: When the air curtain was formed; temperature rise was about 2° C.

When the air curtain was not formed; temperature rise was about 22° C.

Thus, with the air shutter of the present invention, significant effect of interception was achieved.

Referring to FIG. 5A showing fan arrangement in the air shutter of the third embodiment according to the present invention, reference numeral 40 are fans of similar construction as the fans 12*c*, 13*c* of the first and second embodiment. A first fan group 40*a* includes three of the fans 40 located vertically parallel to each other in the upper part of the suction duct 13*d* formed inside a gatepost 13 so that air is spouted out into the opening area 010 through an upper slit nozzle 13*a*1 provided in the upper part of the suction duct 13*d*.

A second fan group 40*b* includes three of the fans 40 located vertically parallel to each other in the lower part of the suction duct 13*d* so that air is spouted out into the opening area 010 through a lower slit nozzle 13*a*2 provided in the lower part of the suction duct 13*d*.

In a gatepost 12 are formed an upper suction duct 12*d*1 and a lower suction duct 12*d*2, both the ducts being separated with a partition member 41.

A third fan group 40*c* includes two of the fans 40 located vertically parallel to each other in the lower part of the upper suction duct 12*d*1 so that air is spouted out into the opening area 010 through an intermediate slit nozzle 12*a*1 provided in the lower part of the suction duct 12*d*1. A fourth fan group 40*d* includes two of the fans 40 located vertically parallel to each other in the upper part of the lower suction duct 12*d*2 so that air is spouted out into the opening area 010 through an intermediate slit nozzle 12*a*2 provided in the upper part of the suction duct 12*d*2.

The air blown by the first fan group 40*a* provided in the upper part of the suction duct 13*d* in the gatepost 13 passes through the opening area 010 and flows into the upper suction duct 12*d*1 in the gatepost 12 from the suction opening 12*b*1. The air further flows through the suction passage 42*c* of the third fan group 40*c* to be sucked by each fan 40 of the third fan group 40*c*.

The air blown by the second fan group 40*b* provided in the lower part of the suction duct 13*d* in the gatepost 13 passes through the opening area 010 and flows into the lower suction duct 12*d*2 in the gatepost 12 from the suction opening 12*b*2. The air further flows through the suction passage 42*d* of the fourth fan group 40*d* to be sucked by each fan 40 of the fourth fan group 40*d*.

The air blown by the third fan group 40*c* provided in the lower part of the upper suction duct 12*d*1 in the gatepost 12 passes through the opening area 010 and flows into the suction duct 13*d* in the gatepost 13 from the suction opening 13*b*1. The air further flows through the suction passage 42*a* of the first fan group 40*a* to be sucked by each fan 40 of the first fan group 40*a*.

The air blown by the fourth fan group 40*d* provided in the upper part of the lower suction duct 12*d*2 in the gatepost 12 passes through the opening area 010 and flows into the suction duct 13*d* in the gatepost 13 from the suction opening 13*b*2. The air further flows through the suction passage 42*b* of the second fan group 40*b* to be sucked by each fan 40 of the second fan group 40*b*.

According to the third embodiment, the fans and slit nozzles of said gatepost 13 side are located in the upper and lower part of the gatepost 13, air is blown by the first fan group 40*a* located in the upper part toward the suction opening 12*b*1 of the gatepost 12 opposite to the gatepost 13, at the same time air is blown by the second fan group 40*b* located in the lower part toward the suction opening 12*b*2 of the gatepost 12, on the other hand, the suction duct in the gatepost 12 is divided at the intermediate part of the suction duct into the upper and lower suction duct 12*d*1 and 12*d*2, the fans and slit nozzles of the gatepost 12 side are located in the upper and lower part of the suction duct 12*d*1 and 12*d*2 respectively, air is blown by the third fan group 40*c* toward the suction opening 13*b*1 of the gatepost 13 opposite to the gatepost 12, and at the same time air is blown by the fourth fan group 40*d* toward the suction opening 13*b*2 of the gatepost 13, so that the fan groups each consisting of a plurality of fans 40 provided in the gatepost 12 and the gatepost 13 opposite thereto can be provided separately as the first fan group 40*a* located in the upper part of the gatepost 13 and provided with the suction passage 42*a*, the second fan group 40*b* located in the lower part of the gatepost 13 and provided with the suction passage 42*b*, the third fan group 40*c* located above the intermediate part in the gatepost 12 and provided with the suction passage 42*c*, and the fourth fan group 40*d* located under the intermediate part in the gatepost 12 and provided with the suction passage 42*d*.

Figure 5B:
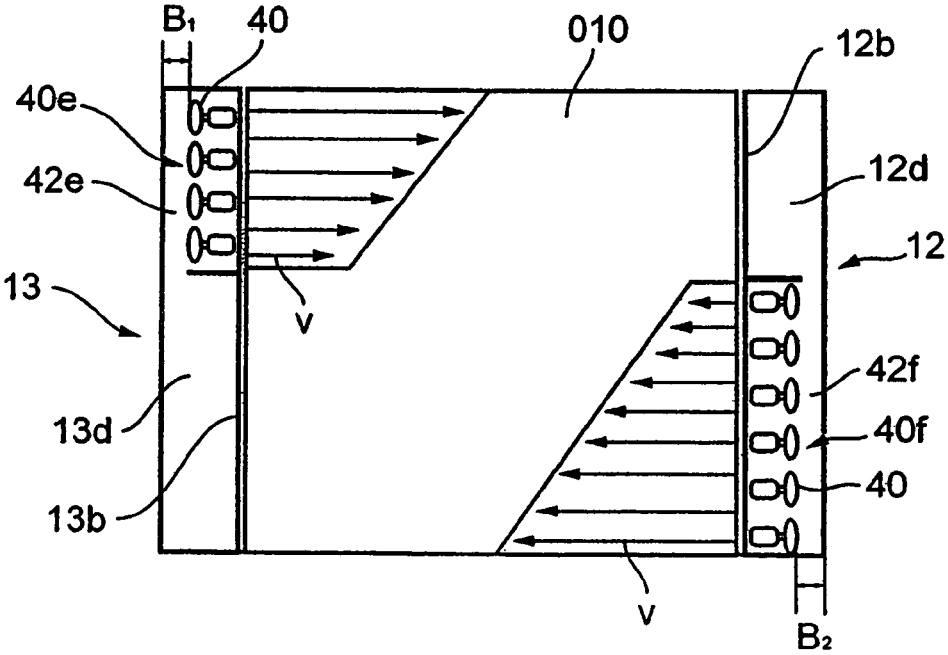
FIG. 5B is a front view of an example for comparison showing fan arrangement.

Therefore, compared with the example for comparison shown in FIG. 5B, in which the gatepost 12 and 13 is provided with a fan group 40*f* and 40*e* respectively and therefore each of the suction passages 42*f* and 42*e* for each fan group is inevitably long resulting in uneven suction pressure between each fan and wide variations in the velocity v of air stream, the suction passage of each of four fan groups in the third embodiment shown in FIG. 5A can be reduced in length resulting in smooth flow passage eliminating the interference of suction flow between the fans.

With the embodiment, suction resistance in each of the suction passages 42*a*, 42*b*, 42*c*, 42*d*, of which the width B1, B2 are generally small, is reduced and the reduction in the velocity of air stream, that means the reduction in air flow rate due to increased negative suction pressure can be prevented together with the reduction in variations in the velocity of air stream.

Further, by providing smoothly curved corner 44, 45 at the end of the suction passage of each of the fan groups, the increase of negative suction pressure of each of the fans located at the corner can be suppressed.

In the fourth embodiment of the present invention shown in FIG. 6, a short curtain 46 consisting of a plurality of curtain cloths of different length is hung from an upper crossbeam 16 installed on a gatepost 12 and gatepost 13 for interrupting heat flow between the inside and outside of the opening area 010 in the upper part thereof. The length H1 of the short curtain 46 is about a half the height H of the opening area 010 or shorter in order to form an area 46*a* below the curtain 46 to allow the easy passing of a cargo vehicle.

With the fourth embodiment, the effect of interruption of heat flow in the upper part of the opening area 010 can be enhanced by the short curtain 46 in addition to that the difference in temperature between the interception air streams and the cold air inside the storage is decreased by the circulation of the air of the interception air streams.

Since the short curtain 46 is provided only in the hot air interception zone in the upper part of the opening area 010 and it does not shield the middle and lower part of the opening area 010, the short curtain 46 does not obstruct viewing the inside of the cold storage and at the same time does not interfere with the advancing of a service vehicle such as a forklift truck in and out of the cold storage.

The fifth embodiment shown in FIG. 7, 8 relates to a method of installation of the air shutter of the present invention. In the embodiment, each of the gateposts 12, 13 of the air shutter is provided with a seal element 35 running along them in the direction of height, the seal element 35 always contact with doors 36, which are allowed to slide along the thermal insulation wall 37 of the storage, to perform air sealing between the gateposts and doors. With the embodiment, the air sealing between the gateposts 12, 13 and the opened area W of the doors 36 can be positively achieved by simply providing the seal elements 35 on the gateposts such that the doors 36 slide keeping contact with the seal elements 35.

EFFECT OF THE INVENTION

The present invention was made based on the consideration of the experimental data of the flowage of air across the opening area of the doorway of a cold storage, and provides an air shutter of low cost and high efficiency, which can form effective circulating interception air stream in the opening area of a doorway, is easy in maintenance, and is easily applicable to various types of doors.

According to the invention, by composing such that fans are divided in four groups, each group having a suction passage, the suction resistance to each group of fans is reduced, so that the increase in negative suction pressure due to the small width of suction passages can be suppressed and the decrease of the velocity, i.e. the flow rate of circulating interception air stream due to increased negative suction pressure can be prevented.

Further, according to the invention, since the short curtain is provided only in the hot air interception zone in the upper part of the opening area and it does not shield the middle and lower part of the opening area, the short curtain does not obstruct viewing the inside of the cold storage and at the same time does not interfere with the advancing of a service vehicle such as a forklift truck in and out of the cold storage.

Still further, according to the invention, the air sealing between the gateposts and the doors can be positively achieved by simply providing the seal elements on the gateposts such that the doors slide keeping contact with the seal elements.

What is claimed is:

1. An air shutter to be installed in front of a doorway where temperature difference exists between the inside and outside thereof in order to interrupt the flowage of air through the doorway to interrupt the flowage of air through the doorway, wherein a pair of gateposts is installed of which each gatepost is provided at each side of the doorway to oppose to each other, a duct for air passage being formed in each gatepost, each gatepost being provided with air spouting out openings and air sucking openings along the direction of height such that each of the air spouting out openings of one side gatepost faces, or is opposite to, each of the air sucking openings of the other side gatepost respectively, a plurality of fans being provided behind each of said air spouting out openings; one of the gatepost is provided with the air spouting openings and fans located in the upper part and in the lower part thereof; the other of the gatepost is provided with the air spouting openings and fans located in the middle part in the direction of height thereof; and air is spouted out from the air spouting openings toward the corresponding opposite air sucking openings.

2. The air shutter according to claim 1, wherein the fans located in the middle part are divided into two groups, and each group of fans sucks air through each passage divided into two by a partition member for dividing the duct inside the other side gatepost.

* * * * *